US006322261B1

(12) United States Patent
Kuzyk

(10) Patent No.: US 6,322,261 B1
(45) Date of Patent: Nov. 27, 2001

(54) PHOTOGRAPHIC DEVELOPER WITH AUTOMATED MIXING AND REPLENISHING

(75) Inventor: Roman Kuzyk, Trenton, NJ (US)

(73) Assignee: Photo-Therm, L.P., Trenton, NJ (US)

( * ) Notice: Subject to any disclaimer, the term of this patent is extended or adjusted under 35 U.S.C. 154(b) by 0 days.

(21) Appl. No.: 09/504,708

(22) Filed: Feb. 16, 2000

(51) Int. Cl.[7] ..... G03D 3/04
(52) U.S. Cl. ..... 396/625; 396/635
(58) Field of Search ..... 396/626, 633–635, 396/625

(56) References Cited

U.S. PATENT DOCUMENTS

| | | | | |
|---|---|---|---|---|
| Re. 34,188 | | 3/1993 | Kuzyk et al. | 396/626 |
| 4,421,399 | * | 12/1983 | Steube | 396/626 |
| 4,577,950 | * | 3/1986 | Mackson | 396/626 |
| 4,586,805 | * | 5/1986 | Bockemiihl-Simon et al. | 396/626 |
| 5,057,858 | * | 10/1991 | Woog | 396/626 |
| 5,331,364 | * | 7/1994 | Borden | 396/626 |
| 5,379,086 | * | 1/1995 | Kuzyk | 396/626 |

* cited by examiner

*Primary Examiner*—D. Rutledge
(74) *Attorney, Agent, or Firm*—Dann, Dorfman, Herrell and Skillman, P.C.

(57) ABSTRACT

A film developing apparatus is provided for developing photographic film by an automated batch process. The apparatus provides automated preparation of precise mixtures of the processing liquids at various stages of the batch process. The mixtures are made on-demand and are preheated just before use in the batch process. Additionally, the apparatus provides a method to reuse used processing fluids in future processing. In particular, the apparatus makes use of its mixing capability to combine a reserved processing fluid with a fresh processing fluid to create a replenished processing fluid.

130 Claims, 5 Drawing Sheets

PHOTOGRAPHIC DEVELOPER WITH AUTOMATED MIXING AND REPLENISHING

FIELD OF THE INVENTION

The present invention relates generally to an automated photographic developer, and more particularly to a photographic developer which automatically mixes processing fluids in small batches, on-demand, and also replenishes used processing fluids.

BACKGROUND OF THE INVENTION

Development of photographic film by the "wet" process exposes the film to a series of chemicals in either a continuous or batch process. In batch processing, film or paper is loaded into a single drum, and a sequence of chemicals is added and removed from the drum to effect development of the film. Proper development requires precise control of the concentration of the chemicals, temperature of the chemicals, and the time the film is exposed to the chemicals. Typically these chemicals are supplied in concentrated form as single or multiple concentrates and are diluted to the proper concentration for use in the developing process.

Each process of film development requires different concentrations. Making such a large array of chemicals ahead of time creates a problem in that the shelf-life of these chemicals is decreased once they are in diluted form. As a result, there is a reasonable chance that some chemicals may remain unused for a long period of time, exceed their shelf life, and thus be wasted. In addition, preparation of these chemicals by hand is undesirable as it exposes the operator to unnecessary potential contact with the chemicals.

It is therefore highly desirable to provide a device that is capable of mixing a diverse variety of chemicals on an as-needed basis. It is further desirable to provide an apparatus that performs this function automatically without the need for manual dilution and preparation of the chemicals.

SUMMARY OF THE INVENTION

The present invention is a film developing apparatus for developing photographic film by an automated batch process. The apparatus provides automated preparation of precise mixtures of the processing fluids at various stages of the batch process. These mixtures are made on-demand and pre-heated just before they are needed in the batch process. Additionally, the apparatus provides a method to reuse used processing fluids in future processing. In particular, the apparatus makes use of its mixing capability to combine a used processing fluid with a fresh concentrate to create a replenished processing fluid.

In general, an apparatus for batch processing film is provided. The apparatus includes at least one connector for connection with a source reservoir containing at least a first processing liquid including a processing chemical concentrate. Optionally, additional source reservoirs may be provided to contain, for example, water for use in the mixing of an original fresh fluid treatment mixture or an additional processing chemical concentrate for replenishing a used treatment mixture.

A mixing tank is provided for fluid communication with the source reservoir for receiving and mixing the processing liquid to provide a selected fluid treatment mixture. The processing liquid may be mixed with water to provide an original fresh treatment mixture for immediate use in the batch process. Alternatively, the processing liquid may be mixed with the used treatment mixture to provide a replenished mixture for immediate use in the batch process.

A valve is in fluid communication with the source reservoir and with the mixing tank to control the flow of processing liquid, such as a chemical concentrate for an original mixing procedure or a replenishing procedure or water for an original mixing procedure, from the source reservoir into the mixing tank. The valve also functions to control the flow of used fluid mixture from a discharge reservoir into the mixing tank for use in a replenishing procedure.

A processing drum is in fluid communication with the mixing tank for receiving the selected fluid mixture from the mixing tank. A film holder may be provided in the processing drum for holding a batch of film to be processed in position contained within the drum for processing in the selected fluid mixture in the drum. The film holder functions to hold a selected batch of film for batch processing rather than functioning to feed a continuous strip of film through the fluid treatment mixture.

A liquid detector may be in communication with the valve to enable the start of a liquid flow at the valve to be detected to enable the controller to control the pump to meter either a processing liquid from the source reservoir or the used treatment mixture from the discharge reservoir into the mixing tank. When the liquid detector is used in conjunction with a positive displacement pump, accurate quantities of processing liquid or used treatment fluid can be metered into the mixing tank. A flow sensor for sensing fluid flow at the valve may also be used in conjunction with the liquid detector to ensure precise metering of processing liquid or used treatment fluid into the mixing tank. Furthermore, a volume level sensor may be used in the mixing tank to sense the level of liquid in the tank so that correct amounts of liquid in the mixing tank can be confirmed or calculated.

More specifically, the apparatus may include several source and reuse reservoirs each containing a particular processing fluid, such as developer, bleach, fixer, or water. The reuse reservoirs specifically contain a used processing fluid in reserve for future reuse. A selector valve is connected to the source reservoir and reuse reservoirs. The selector valve connects the selected reservoir to a pump which pumps a processing fluid from the selected reservoir into the mixing tank. Additional reservoirs are optionally selected by the selector valve and pumped by the pump into the mixing tank. The mixing tank stirs the processing fluids and heats the processing fluids to a preselected temperature to create either an original treatment mixture or a replenished used mixture.

A second pump connects the mixing tank to the processing drum and pumps the fluid mixture from the mixing tank into the processing drum which contains film to be developed. Once processing with the current processing solutions is completed, the solutions are either discharged to a waste container or are discharged to one of the reuse reservoirs for later replenishment. The apparatus repeats this process creating further batches of processing fluid and further processing the film until the film development processes are complete.

BRIEF DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

A film developing apparatus, generally designated 8, is provided for developing photographic film by an automated batch process in which the processing fluids are prepared as needed for each step of the process. The apparatus provides automated preparation of precise mixtures of the processing fluids at various stages of the batch process. These mixtures are made on-demand and pre-heated just before they are needed in the batch process. Additionally, the apparatus provides a method to individually reserve the used processing fluids and reuse these fluids in future processing. In particular, the apparatus makes use of its on-demand mixing capability to combine a previously used processing mixture with a fresh, unused processing concentrate to create a replenished form of the reserved processing fluid. Alternatively, an original treatment mixture can be created for on demand use in the film processing procedure by mixing at least one concentrate with a supply of water.

Figure 1:
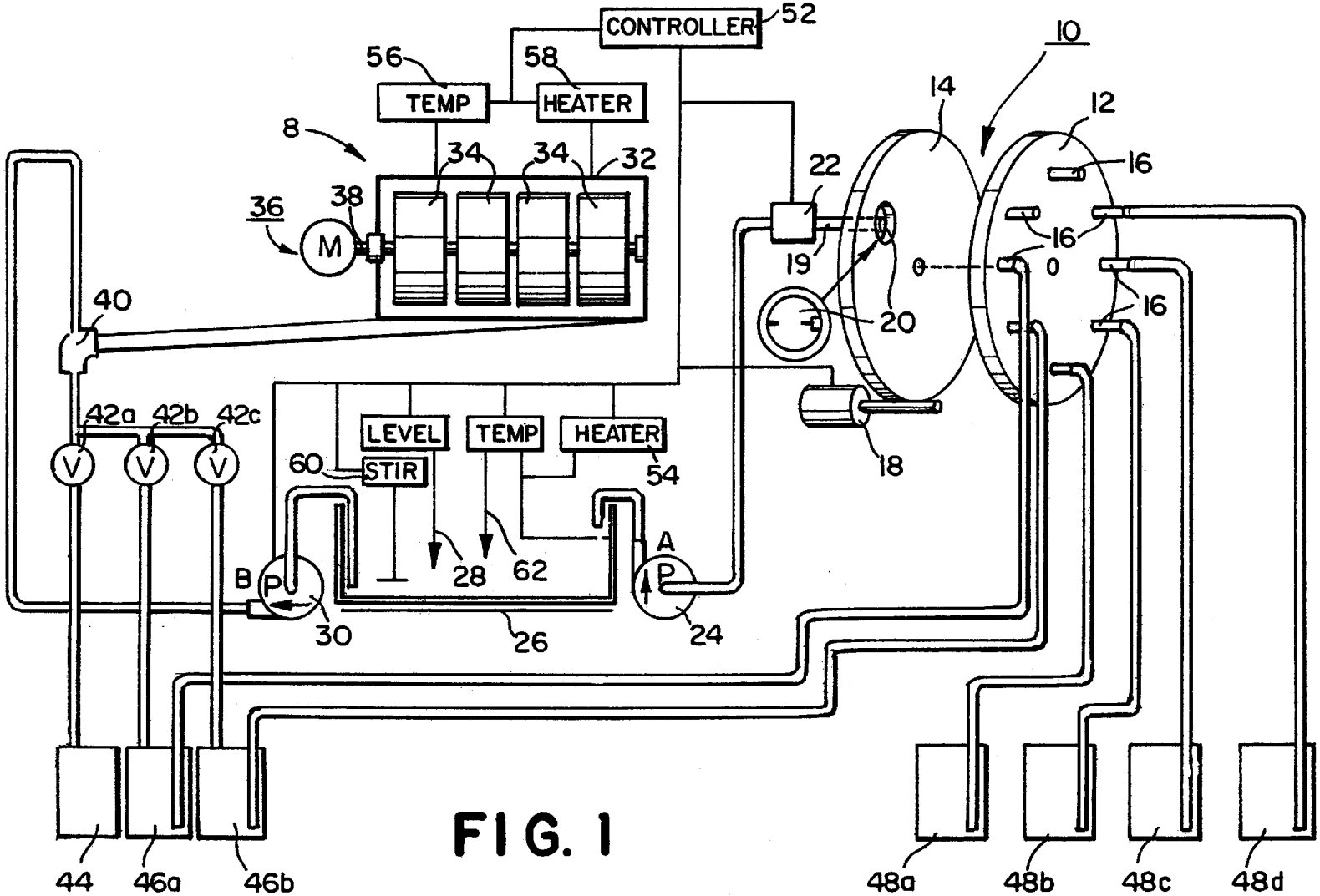
FIG. 1 is a schematic view of a photographic developer of the present invention.

Referring now to the drawings, FIG. 1 illustrates a schematic representation of the photographic developer 8 of the invention. The apparatus 8 includes several source reservoirs 48*a–d* and two reuse reservoirs 46*a–b* each in fluid communication with a selector valve 10 for selecting one of the source reservoirs 48 or reuse discharge reservoirs 46. The selector valve 10 is controlled by a controller 52 and is connected to source reservoirs 48 and reuse reservoirs 46 via appropriate tubing such as plastic tubing or rubber tubing. The source reservoirs 48 each contain a predetermined processing fluid for use in the development of photographic film, such as developer, bleach, fixer, or water, any of which (except water) preferably may be in concentrated form. The reuse reservoirs 46 each contain a predetermined processing fluid that has already been used in the development process and is reserved for future reuse.

Figure 3:
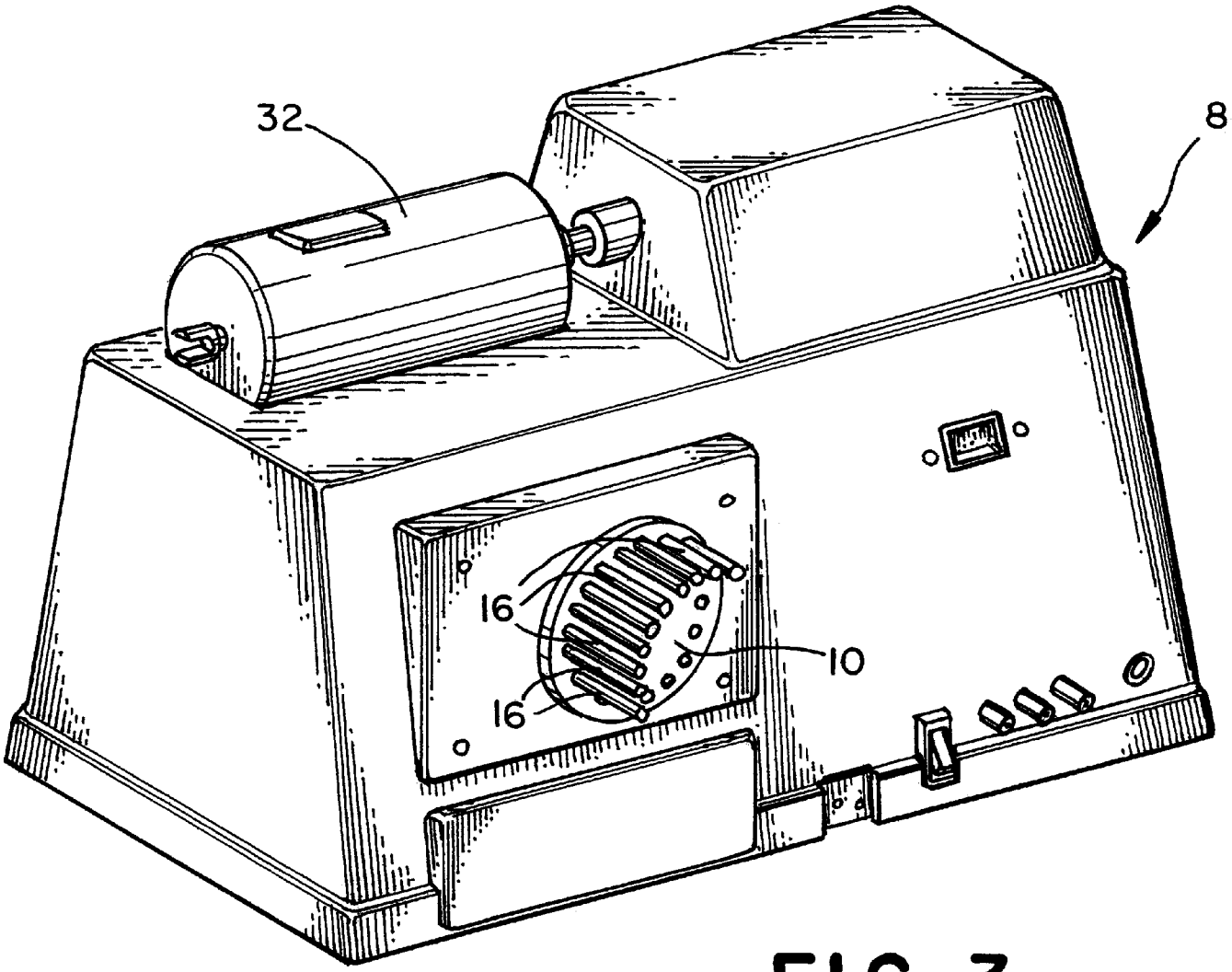
FIG. 3 illustrates a perspective view of a photographic developer of the present invention.

The selector valve 10 is preferably a rotational valve comprising a first stationary disk 12 for connection to the source reservoirs 48 and the reuse reservoirs 46, and a second rotatable disk 14 for selecting a predetermined reservoir. The stationary disk 12 includes a plurality of inlet ports 16 mounted circumferentially around a first planar surface of the stationary disk 12, as shown in FIG. 3, with each inlet port 16 connected to a respective source reservoir 48 or a respective reuse reservoir 46. Each inlet port 16 is mounted on the first outside planar surface at an equal radial distance measured from the center of stationary disk 12.

Figure 4:
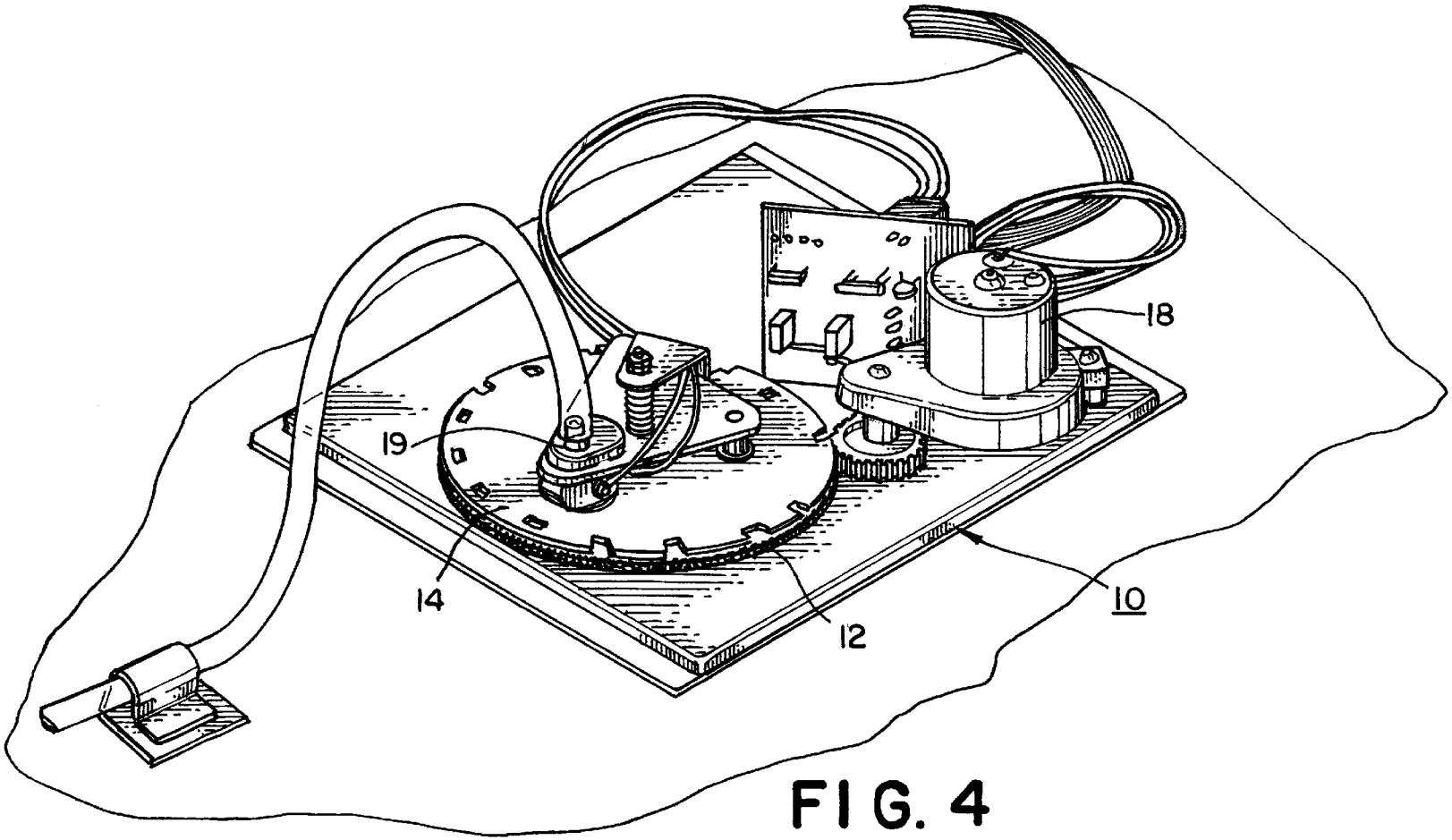
FIG. 4 illustrates an enlarged perspective view of a rotational valve used in the photographic developer illustrated in FIG. 3.
Figure 5:
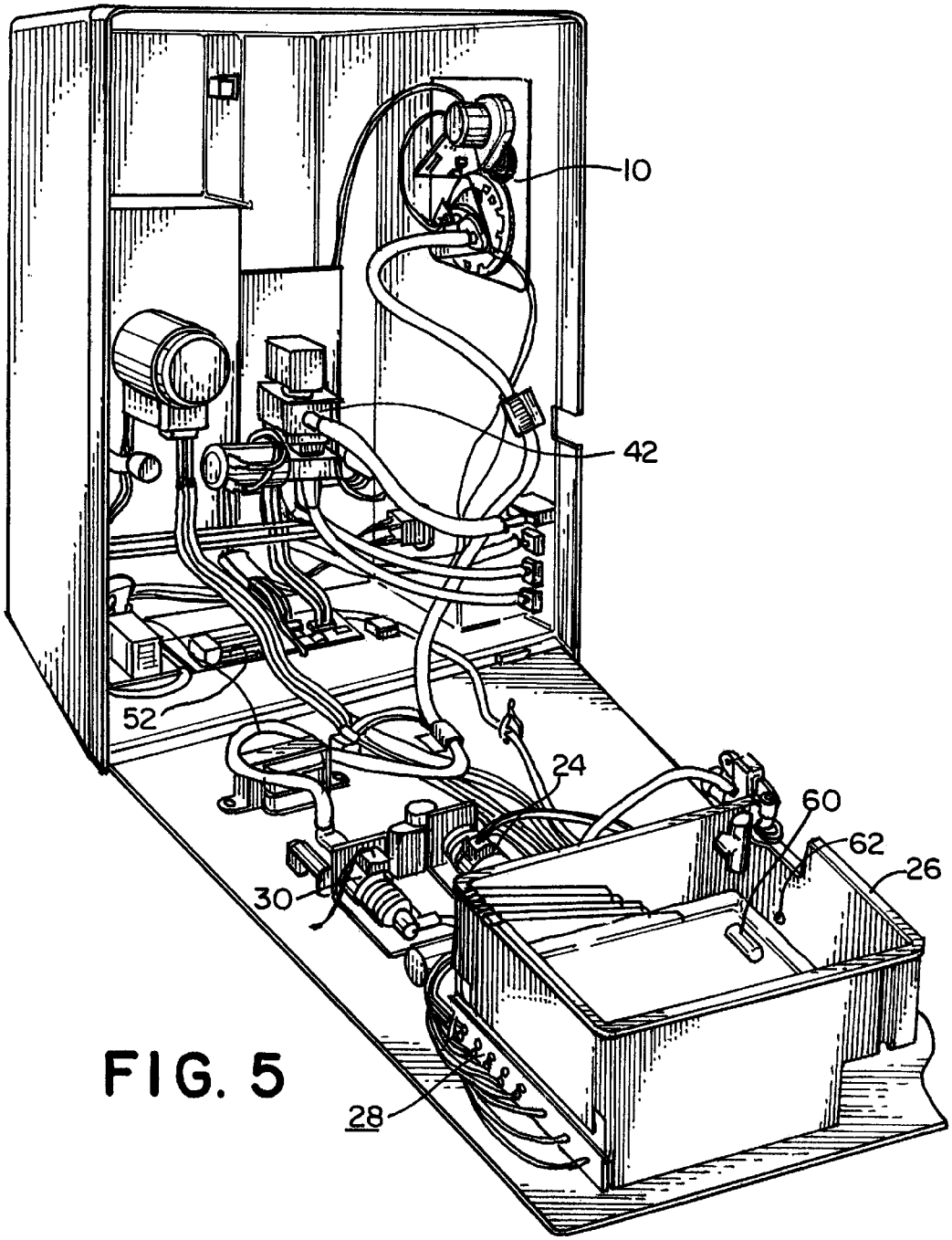
FIG. 5 illustrates a perspective view of the internal components of the photographic developer shown in FIG. 3.

The rotatable disk 14 is rotatably mounted in facing contact with a second inner surface of stationary disk 12, which is parallel to the first surface of stationary disk 12. Specifically, the rotatable disk 14 rotates about a rotational axis that is perpendicular to the first surface of rotatable disk 14 and that passes through the center of rotatable disk 14. The center of stationary disk 12 is aligned with the rotational axis of rotatable disk 14. The rotatable disk 14 includes an outlet port 19, as shown in FIG. 4, mounted on a planar surface of rotatable disk 14. The outlet port 19 is mounted at a radial distance from the center of rotatable disk 14 equal to the radial distance from the center of stationary disk 12 at which the inlet ports 16 are mounted. Thus, the rotatable disk 14 is capable of rotating to preselected positions so that the outlet port 19 is in registration with a desired inlet port 16, thereby selecting a particular reservoir. Preferably, gaskets or other suitable sealing means, ensures that outlet port 19 and the selected inlet port 16 are sealably connected in fluid communication.

The rotatable disk 14 may be rotated manually or may be rotated using a motor 18 controlled by controller 52. Preferably, rotatable disk 14 further includes a conductivity sensor 20, operably connected to controller 52, that functions as a liquid detector for detecting the presence of a liquid within outlet port 19. The outlet port 19 is connected in fluid communication to a load pump 24, controlled by controller 52, via appropriate tubing, such as rubber, plastic, or metal tubing. The rotatable disk 14 is further rotatable to mis-register the outlet port 19 with respect to the inlet ports 16, so that the outlet port 19 is open to air so that the load pump 24 may evacuate all the processing fluid present in the tubing between the load pump 24 and outlet port 19 as air replaces the pumped processing fluid. In addition, the mis-registry of the inlet port 16 and the outlet port 19 functions to enable liquid in the tube connected to the inlet port to drain back into the respective reservoir by a syphoning action to eliminate any potential contaminating liquid drips.

Preferably, a flow sensor 22, in communication with controller 52, is operably connected to the outlet port 19 and the load pump 24 to provide more precise metering of the quantity of fluid flowing into the load pump 24. The flow sensor 22 functions to detect and measure fluid flow to the load pump 24. The flow sensor 22 may cooperate with the conductivity sensor 20 to accurately meter precise amounts of liquid to the mixing tank 26. The conductivity sensor functions to distinguish between air flow and liquid flow so that the flow meter can be used to detect and measure precise liquid flow to the load pump. Pump 24 is preferably a positive displacement pump. Pump 24 is further in fluid communication with a mixing tank 26. When load pump 24 is actuated and outlet port 19 is in registration with an inlet port 16, load pump 24 pumps a processing liquid from the corresponding reuse reservoir 46 or source reservoir 48 in fluid communication with the outlet port 19 to the mixing tank 26. Again, the conductivity sensor 20 distinguishes between liquid flow and air flow so that the positive displacement pump can be controlled by the controller to meter an accurate quantity of processing liquid or used fluid mixture to the mixing tank 26. The controller 52 monitors the quantity of fluid pumped by the load pump 24. Additional reservoirs may optionally be selected by the selector valve 10 and pumped by the load pump 24 into the mixing tank 26 to formulate a selected processing fluid mixture from the processing fluids.

The mixing tank 26 includes a stirrer 60, which may be a magnetic stirrer, mechanical stirrer or other suitable stirrer for stirring the processing fluids. The stirrer 60 is controlled by controller 52. Additionally, a heater 54, in communication with controller 52, is operably connected to the mixing tank 26 for heating processing fluids to a preselected temperature appropriate to the corresponding processing step. Further, a temperature sensor 62 for monitoring the temperature of the processing fluids and a level sensor 28 for measuring the level of the processing fluids in the mixing tank 26 are both operably connected to the mixing tank 26. The temperature sensor 62 and level sensor 28 are in communication with controller 52. The level sensor 28 functions as a volume level sensor to verify that the mixing tank has been filled to proper capacity for the desired mixture. For example, the level sensor will detect that the appropriate amount of water is being added to a selected concentrate in the mixing tank to effect a proper original treatment mixture. Likewise, the level sensor 28 may function to detect that the appropriate amount of used treatment mixture from a discharge reservoir has been added to a concentrate in the mixing tank to effect a proper replenished fluid mixture. The level sensor may be in the form of a plurality of finger sensors to detect different levels of liquid volume in the mixing tank. A fill pump 30, controlled by controller 52, is in fluid communication with the mixing tank 26 and processing drum 32. The fill pump pumps the fluid mixture from the mixing tank 26 into the processing drum. A fill-discharge coupling 40 is disposed between the fill pump 30 and the processing drum 32 to direct the flow of the fluid mixture between the fill pump 30 and the processing drum 32. The fill-discharge coupling 40 is in fluid communication with several drain valves 42*a–c* so that the fill-discharge coupling 40 is capable of fluidly connecting the processing drum 32 to either the drain valves 42 or the fill pump 30. When the processing drum is to be filled, drain valves 42*a–c* are closed so that the coupling 40 connects the mixing tank 26 with the processing drum 32. The fill pump 30 stops pumping when the level sensor 28 indicates that the mixing tank 26 is substantially empty. When the processing drum 32 is to be emptied of used treatment mixture, one of the respective drain valves 42*a–c* connects the processing drum 32 so that the used mixture can be discarded into waste reservoir 44 or into one of the appropriate discharge storage reservoirs 46*a* or *b* to store the respective used treatment mixture for subsequent replenishment.

The processing drum 32 includes a hollow interior for receiving a batch of film to be developed and for receiving the processing fluid mixtures from the fill pump 30. The processing drum 32 further includes an agitator 36 for agitating the film within the processing fluid mixture. The agitator 36, controlled by controller 52, includes an agitator rod 38 to which the film may be attached via a film holder 34. Typically, the film holder 34 is in the form of a film reel commonly used for developing film. Alternately, the film holder 34 may be in any other form suitable to hold a batch of film while the film is being developed. The agitator 36 may agitate the film by rotating the film about the axis of the agitator rod 38. Further, the agitator 36 may agitate the film by translating the film back and forth along the direction of a longitudinal axis of agitator rod 38. The processing drum 32 further includes a processing drum temperature sensor 56 for measuring the temperature of the processing fluids within the processing drum 32. Additionally, the processing drum includes a processing drum heater 58 for heating the processing fluid mixture within the processing drum 32 to maintain the temperature of the fluid mixture at the desired temperature. The drum temperature sensor 56 and drum heater 58 are controlled by controller 52.

The walls of the processing drum 32 are preferably formed from a material with suitable thermal conductivity to permit heated fluid or gas to exchange heat with the processing fluid mixture within the processing drum 32. Drain valves 42*b–c,* controlled by controller 52, are connected with respective reuse reservoirs 46*a–b*. Drain valve 42*a* is specifically connected to waste reservoir 44. Waste reservoir 44 is provided to receive all used processing fluids which are not to be directed to reuse tanks 46 for replenishment.

Figure 2:
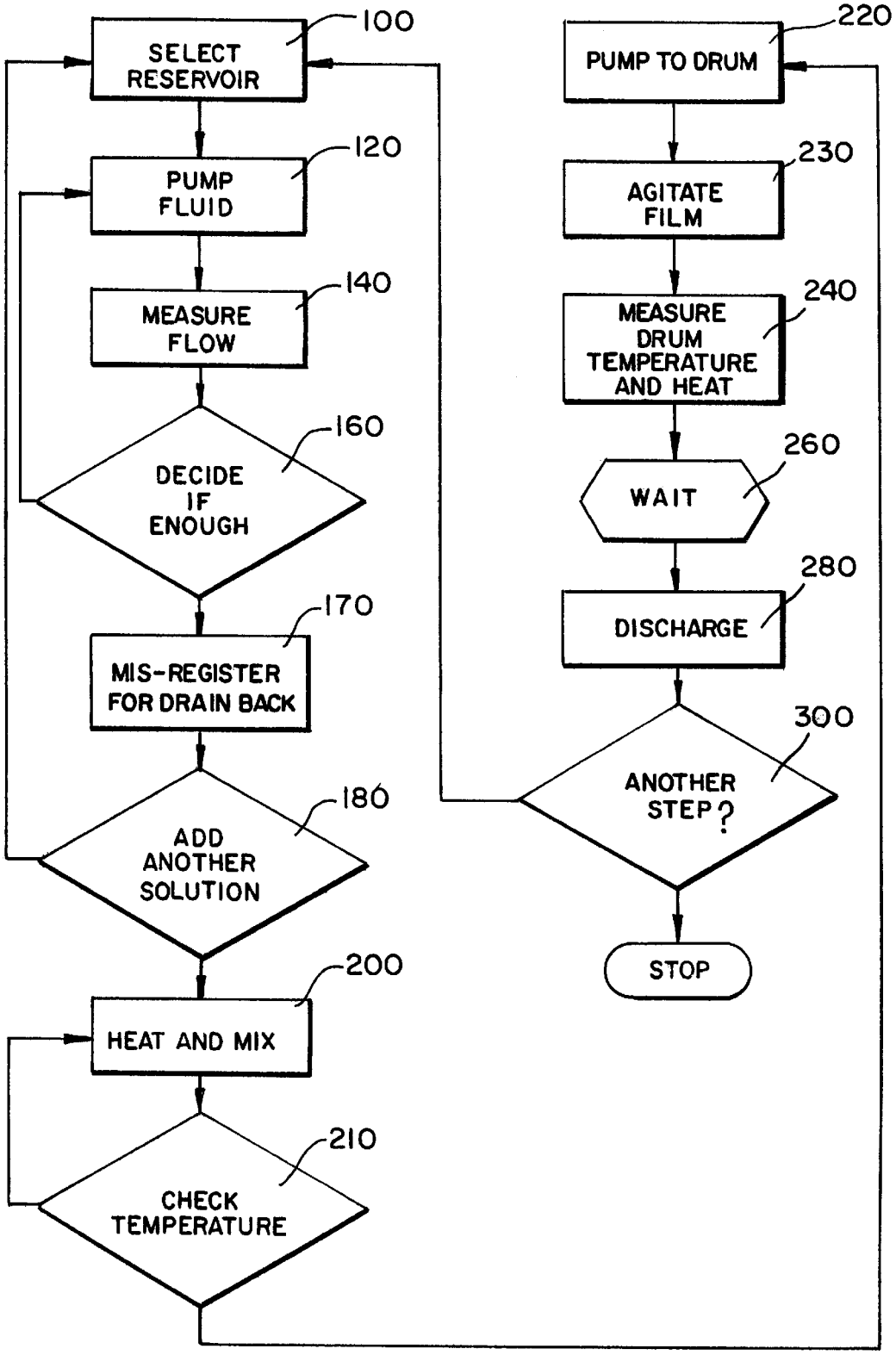
FIG. 2 is a flow chart showing a method for developing film in accordance with the present invention.

The process by which the apparatus processes film is illustrated by the flowchart of FIG. 2. At step 100, the selector valve 10 is actuated to place one of the reuse reservoirs 46 or source reservoirs 48 in fluid communication with the load pump 24. The load pump 24 is activated at step 120 to begin pumping processing fluid from the selected reservoir through the selector valve 10 and through the flow sensor 22 into the mixing tank 26. As the processing liquid is being pumped, the liquid detector 20 and the flow sensor 22 measure the flow at step 140. The controller 52 compares the total quantity of pumped processing liquid sensed by flow sensor 22 in cooperation with liquid detector 20 to a predetermined value at step 160. If the total quantity of processing liquid pumped is less than the predetermined value, the pumping continues. If, however, the total quantity of processing fluid pumped equals the predetermined value, the rotatable disk 14 is rotated so that the outlet port 19 is not in registration with the inlet port 16. The outlet port is open to air at step 170, and the liquid in the tubing connected to the inlet port drains back to its respective reservoir. This evacuation of liquid away from the outlet port is preferable, since this decreases the chance that fluid from a reuse reservoir 46 or source reservoirs 48 will contaminate another processing fluid. The pumping continues for a predetermined time sufficient to remove the processing liquid from the tubing connecting outlet port 19 to load pump 24. This evacuation is essential since it permits the level sensors 28 to accurately monitor the quantity of liquid in the mixing tank 26. If an additional processing liquid is to be mixed with the processing liquid already pumped, steps 100 through 180 are repeated.

Once the mixing tank 26 is filled with all the processing liquid required for the upcoming batch processing step, the processing liquids are stirred by the stirrer 60 and optionally heated by the heater 54 at step 200. If the processing fluids are being heated at step 200, the mixing tank temperature sensor 62 monitors the temperature of the processing liquids. When the processing liquids are at the desired temperature and the processing drum 32 is ready to receive the mixture of processing liquids, at step 210, the fill pump 30 is actuated to pump the fluid mixture into the processing drum 32 at step 220. The film within processing drum 32 is agitated in the processing mixture at step 230 by the agitator 36. While the agitation is taking place at step 230, the temperature of the processing mixture within the processing drum 32 is monitored by processing drum temperature sensor 56. The processing mixture may be heated as needed by processing drum heater 58, at step 240, to maintain proper temperature. The agitation, temperature monitoring, and optional heating continue for the preselected time interval, at step 260. If no further processing is required to develop the film, the process ends. If, however, further processing is required steps 100 through 210 may be performed to prepare the next batch of processing fluids while steps 220 through 280 are being performed using the present processing fluids. Steps 100 through 300 are thus repeated throughout the process of the film development until the batch processing is complete.

The unit is calibrated by pumping a processing liquid into the mixing tank 26 to the desired level detected by level sensor 28. The controller 52 thereby detects the actual total volume. The operator enters the required percentages of the used processing fluids contained in reuse reservoirs 46. The controller 52 then calculates the required volume of one or more corresponding fresh processing fluid concentrates to be pumped from a selected source reservoir 48 for a corresponding used processing fluid.

Replenishing is the addition of a concentrated processing fluid to make a used processing fluid as active as the original processing fluid. With the foregoing apparatus and system, multiple components can be replenished. Efficiency is achieved by the use of a single pump for the base chemical as well as all replenishing concentrates. Since replenishing is effected under the control of a processor, convenient digital entry of the percentage of concentrates for use in replenishment can be made. The processor can control the function of the system so that precise fluid volumes can be added to obtain precise chemical mixing. After the desired proportions of selected chemical solution additives are entered to the controller, operation of the load pump in response to the flow sensor and the conductivity sensor is controlled by the controller to effect precise metering of the solution additives.

The apparatus may also be used to effect precise original mixing of a fresh photo processing solution. In this regard, the load pump, under the control of the controller, pumps a selected chemical concentrate from a source reservoir or bottle into the mixing tank. The load pump also pumps water from another source reservoir into the mixing tank until a level sensor in the mixing tank detects the requisite level of solution in the mixing tank corresponding to the percentages entered into the controller. The solution is mixed and heated in the mixing tank and is then pumped to the processing drum. The next solution is pumped into the mixing tank in the same manner. After the solution in the processing drum has resided there for the desired time period, the solution is directed to a drain bottle or to an appropriate reuse reservoir.

From the foregoing, it can be appreciated that the system and apparatus can be programmed to perform original mixing or replenishing. Furthermore, some solution can be mixed while another solution can be replenished in the same process. Mixing typically requires more accuracy than replenishing. The positive displacement load pump is generally accurate enough for replenishing. However, use of the flow sensor in conjunction with the conductivity sensor enables differentiation between air flow and liquid flow to ensure accurate metering of a processing liquid to achieve original mixing.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An apparatus for batch processing film comprising:

a plurality of connectors for fluid communication with a plurality of source reservoirs each containing a processing liquid;

a mixing tank in fluid communication with the plurality of reservoirs for receiving and mixing selected processing liquids to provide a selected fluid mixture;

a valve for fluid communication with the source reservoirs and in fluid communication with the mixing tank for controlling the flow of processing liquid from the source reservoirs to the mixing tank;

a processing drum in fluid communication with the mixing tank for receiving the selected fluid mixture from the mixing tank; and a film holder located within the processing drum for holding a batch of film to be processed in position contained within the drum for processing in the selected fluid mixture within the drum.

2. The apparatus according to claim 1 wherein the plurality of source reservoirs includes a first source reservoir for a first processing liquid including a first selected processing chemical concentrate.

3. The apparatus according to claim 2 wherein the plurality of source reservoirs includes a second source reservoir for a second processing liquid including water to create the selected fluid mixture as a fresh mixture for processing film.

4. The apparatus according to claim 3 wherein the plurality of source reservoirs includes a third source reservoir for a third processing liquid including another selected chemical concentrate.

5. The apparatus according to claim 2, 3, or 4 including a liquid detector in communication with the valve to enable the start of a liquid flow to be detected to enable precise metering of each processing liquid into the mixing tank.

6. The apparatus according to claim 5 including a flow sensor in communication with the valve to detect the volume of fluid flow at the flow sensor, the flow sensor cooperating with the liquid detector to meter liquid flow of each processing liquid into the mixing tank.

7. The apparatus according to claim 5 including a positive displacement pump in communication with the valve and cooperating with the liquid detector to enable a precise amount of each processing liquid to be dispensed into the mixing tank upon detection of a liquid flow by the liquid detector.

8. The apparatus according to claim 7 including a drain-back device cooperating with the valve and the source reservoirs to enable processing liquid to flow back into the respective source reservoir after the desired amount of such processing liquid has been pumped into the mixing tank.

9. The apparatus according to claim 7 including a flow sensor in communication with the valve to detect the volume of fluid flow at the flow sensor to enable metering of the processing liquid into the mixing tank.

10. The apparatus according to claim 7 including a controller for controlling operation of the valve, the pump and the liquid detector to enable precise amounts of processing liquid to be dispensed into the mixing tank.

11. The apparatus according to claim 2 including at least one discharge connector for connection with a discharge reservoir for receiving used fluid mixture from the processing drum.

12. The apparatus according to claim 11 including a pump coupled with the source reservoirs to pump at least the first processing liquid of the first processing chemical concentrate into the mixing tank to replenish used fluid mixture.

13. The apparatus according to claim 12 including a liquid detector in communication with the valve for detecting the start of a liquid flow to enable the pump to meter a precise amount of the processing chemical concentrate into the mixing tank.

14. The apparatus claim 12 wherein the source reservoirs include a second source reservoir for a second selected chemical concentrate and wherein the pump operates to pump the second chemical concentrate into the mixing tank.

15. The apparatus of claim 14 including a liquid detector in communication with the valve for detecting the start of a liquid flow to enable the pump to meter a precise amount of the respective first and second processing chemical concentrates into the mixing tank.

16. The apparatus of claim 13 or 15 including a flow sensor in communication with the valve to detect the volume of fluid flow at the flow sensor, the flow sensor cooperating with the liquid detector to meter liquid flow of each processing liquid into the mixing tank.

17. The apparatus according to claim 12 wherein the pump is in communication with the discharge reservoir for pumping a selected amount of used fluid mixture from the discharge reservoir to the mixing tank to mix with the first processing chemical concentrate to produce a replenished fluid mixture.

18. The apparatus according to claim 17 including a volume level sensor in the mixing tank for sensing the volume of replenished fluid mixture in the mixing tank.

19. The apparatus according to claim 14 wherein the pump is in communication with the discharge reservoir for pumping a selected amount of used fluid mixture from the discharge reservoir to the mixing tank to mix with the first and second processing chemical concentrates to produce a replenished fluid mixture.

20. The apparatus according to claim 19 including a volume level sensor in the mixing tank for sensing the volume of replenished fluid mixture in the mixing tank.

21. The apparatus according to claim 6 wherein the flow sensor includes a conductivity sensor for sensing the presence of a liquid.

22. The apparatus according to claim 2 or 11 wherein the valve is a rotational valve.

23. The apparatus according to claim 22 wherein the valve includes a first surface and a second surface rotatably mounted relative to the first surface, the first surface having a plurality of inlet ports connectable to the plurality of reservoirs, the second surface having an output port connected to the mixing tank, and the second surface being rotatable to register the outlet port to be in fluid communication with a selected inlet port.

24. The apparatus according to claim 23 comprising a motor operably connected to the rotational valve for rotating the second surface to select a processing liquid.

25. The apparatus according to claim 1 comprising a motor operably connected to the valve, the motor for actuating the valve to select a fluid input.

26. The apparatus according to claim 1 wherein the valve is positionable to select one reservoir from the plurality of reservoirs to be in fluid communication with the mixing tank.

27. The apparatus according to claim 1 wherein the mixing tank includes a heater for heating the fluid mixture.

28. The apparatus according to claim 1 wherein the mixing tank includes a temperature sensor for measuring the temperature of the fluid mixture.

29. The apparatus according to claim 1 wherein the mixing tank includes a magnetic stirrer for mixing the fluid mixture.

30. The apparatus according to claim 1 comprising a first pump in fluid communication with the valve and in fluid communication with the mixing tank for pumping the processing liquids from the plurality of reservoirs.

31. The apparatus according to claim 30 wherein the first pump is a positive displacement pump.

32. The apparatus according to claim 31 comprising a level sensor operably connected to the mixing tank for measuring the fluid level within the mixing tank.

33. The apparatus according to claim 30 comprising a second pump in fluid communication with the mixing tank and in fluid communication with the processing drum for pumping the liquid mixture from the mixing tank to the processing drum.

34. The apparatus according to claim 33 wherein the second pump is a positive displacement pump.

35. The apparatus according to claim 1 wherein the processing drum includes a heater for heating the fluid mixture in the drum.

36. The apparatus according to claim 35 wherein the processing drum includes a temperature sensor for measuring the temperature of the fluid mixture in the drum.

37. The apparatus according to claim 1 comprising at least a plurality of discharge reservoirs and at least one drain valve in fluid communication with the processing drum and in fluid communication with the discharge reservoirs, the drain valve selecting a discharge reservoir to receive the fluid mixture from the processing drum.

38. The apparatus according to claim 1 wherein the processing drum includes an agitator for attachment to the film holder and for agitating the film within the fluid mixture.

39. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

rotary selector valving for communication with the connector to control the flow of liquid into the processing drum; and a film holder located within the processing drum for holding a batch of film to be processed in position contained within the drum for processing in the selected fluid mixture within the drum.

40. The apparatus according to claim 39 comprising at least a second connector for connection with a second source reservoir for a second processing liquid including water for communication with the selector valve to supply the second processing liquid to the mixing tank through the selector valving to create the selected fluid mixture as a fresh mixture for processing film.

41. An apparatus for batch processing film comprising:

at least a first connector for connection to a source reservoir containing at least a first processing liquid including a first processing chemical concentrate;

a mixing tank for fluid communication with the source reservoir for receiving the first processing liquid supplied from the first connector and mixing the first processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

a second connector for connection with a second source reservoir for a second processing liquid including water to supply to the mixing tank to create the selected fluid mixture as a fresh mixture for processing film; and a third connector for connection with a third source reservoir for a third processing liquid including another selected processing liquid concentrate for supply to the mixing tank.

42. The apparatus according to claim 39, 40 or 41 including a liquid detector to enable the start of a liquid flow to be detected to enable metering of each processing liquid into the mixing tank.

43. The apparatus according to claim 42 including a flow sensor to detect the volume of fluid flow at the flow sensor, the flow sensor cooperating with the liquid detector to enable liquid flow of each processing liquid to be metered into the mixing tank.

44. The apparatus according to claim 42 including a positive displacement pump cooperating with the liquid detector to enable a precise amount of each processing liquid to be dispensed into the mixing tank upon detection of a liquid flow by the liquid detector.

45. The apparatus according to claim 44 including a drain-back device cooperating with the source reservoirs to enable processing liquid to flow back into the respective source reservoir after the desired amount of such processing liquid has been pumped into the mixing tank.

46. The apparatus according to claim 44 including a flow sensor to detect the volume of fluid flow at the flow sensor to enable metering of the processing liquid into the mixing tank.

47. The apparatus according to claim 44 including a controller for controlling operation of the pump in response to the liquid detector to enable precise amounts of processing liquid to be dispensed into the mixing tank.

48. The apparatus according to claim 39 including at least one discharge connector for connection with a discharge reservoir for receiving used fluid mixture from the processing drum.

49. The apparatus according to claim 48 including a pump coupled with the source reservoir to pump at least the processing liquid including the processing chemical concentrate into the mixing tank to replenish used fluid mixture.

50. The apparatus according to claim 49 including a liquid detector for detecting the start of a liquid flow to enable the pump to meter a precise amount of the processing chemical concentrate into the mixing tank.

51. The apparatus of claim 49 wherein the source reservoir includes a second source reservoir for a second selected chemical concentrate and wherein the pump operates to pump the second chemical concentrate into the mixing tank.

52. The apparatus of claim 51 including a liquid detector for detecting the start of a liquid flow to enable the pump to meter a precise amount of the respective first and second processing chemical concentrates into the mixing tank.

53. The apparatus of claim 50 or 52 including a flow sensor to detect the volume of fluid flow at the flow sensor, the flow sensor cooperating with the liquid detector to enable the pump to meter liquid flow of each processing liquid into the mixing tank.

54. The apparatus according to claim 49 wherein the pump is in communication with the discharge reservoir for pumping a selected amount of used fluid mixture from the discharge reservoir to the mixing tank to mix with the processing chemical concentrate to produce a replenished fluid mixture.

55. The apparatus according to claim 54 including a volume level sensor in the mixing tank for sensing the volume of replenished fluid mixture in the mixing tank.

56. The apparatus according to claim 51 wherein the pump is in communication with the discharge reservoir for pumping a selected amount of used fluid mixture from the discharge reservoir to the mixing tank to mix with the first and second chemical concentrates to produce a replenished fluid mixture.

57. The apparatus according to claim 56 including a volume level sensor in the mixing tank for sensing the volume of replenished fluid mixture in the mixing tank.

58. The apparatus according to claim 43 wherein the flow sensor includes a conductivity sensor for sensing the presence of a liquid.

59. The apparatus according to claim 40 or 48 comprising a valve intermediate the reservoir and the mixing tank to control liquid flow to the mixing tank.

60. The apparatus according to claim 59 wherein the valve includes a first surface and a second surface rotatably mounted relative to the first surface, the first surface having a plurality of inlet ports providing the connectors to the plurality of reservoirs, the second surface having an output port connected to the mixing tank, and the second surface being rotatable to register the outlet port to be in fluid communication with a selected inlet port.

61. The apparatus according to claim 60 comprising a motor operably connected to the rotational valve for rotating the second surface to select a fluid input.

62. The apparatus according to claim 59 comprising a motor operably connected to the valve, the motor for actuating the valve to select a fluid input.

63. The apparatus according to claim 59 wherein the valve is positionable to select one reservoir from the plurality of reservoirs to be in fluid communication with the mixing tank.

64. The apparatus according to claim 39 wherein the mixing tank includes a heater for heating the fluid mixture.

65. The apparatus according to claim 39 wherein the mixing tank includes a temperature sensor for measuring the temperature of the fluid mixture.

66. The apparatus according to claim 39 wherein the mixing tank includes a magnetic stirrer for mixing the fluid mixture.

67. The apparatus according to claim 39 comprising a first pump in fluid communication with the mixing tank for pumping the processing liquid from the reservoir into the mixing tank.

68. The apparatus according to claim 67 wherein the first pump is a positive displacement pump.

69. The apparatus according to claim 68 comprising a level sensor operably connected to the mixing tank for measuring the fluid level within the mixing tank.

70. The apparatus according to claim 67 comprising a second pump in fluid communication with the mixing tank and in fluid communication with the processing drum for pumping the fluid mixture from the mixing tank to the processing drum.

71. The apparatus according to claim 70 wherein the second pump is a positive displacement pump.

72. The apparatus according to claim 39 wherein the processing drum includes a heater for heating the fluid mixture in the drum.

73. The apparatus according to claim 72 wherein the processing drum includes a temperature sensor for measuring the temperature of the fluid mixture in the drum.

74. The apparatus according to claim 39 comprising at least a plurality of discharge reservoirs and at least one drain valve in fluid communication with the processing drum and in fluid communication with the discharge reservoirs, the drain valve selecting a discharge reservoir to receive the fluid mixture from the processing drum.

75. The apparatus according to claim 39 wherein the processing drum includes an agitator for attachment to the film holder and for agitating the film within the fluid mixture.

76. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank; and a film holder located within the processing drum for holding a batch of film to be processed in position contained within the drum for processing in the selected fluid mixture within the drum;

a liquid detector to enable the start of a liquid flow to be detected to enable metering of each processing liquid into the mixing tank; and a flow sensor to detect the volume of fluid flow at the flow sensor, the flow sensor cooperating with the liquid detector to enable liquid flow of each processing liquid to be metered into the mixing tank.

77. The apparatus according to claim 76 wherein the flow sensor includes a conductivity sensor for sensing the presence of a liquid.

78. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

at least a second connector for connection with a second source reservoir for a second processing liquid including water to supply to the mixing tank to create the selected fluid mixture as a fresh mixture for processing film;

a liquid detector to enable the start of a liquid flow to be detected to enable metering of each processing liquid into the mixing tank; and a flow sensor to detect the volume of fluid flow at the flow sensor, the flow sensor cooperating with the liquid detector to enable liquid flow of each processing liquid to be metered into the mixing tank.

79. The apparatus according to claim 78 wherein the flow sensor includes a conductivity sensor for sensing the presence of a liquid.

80. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

at least a second connector for connection with a second source reservoir for a second processing liquid including water to supply to the mixing tank to create the selected fluid mixture as a fresh mixture for processing film;

a third connector for connection with a third source reservoir for a third processing liquid including another selected processing liquid concentrate for supply to the mixing tank;

a liquid detector to enable the start of a liquid flow to be detected to enable metering of each processing liquid into the mixing tank; and a flow sensor to detect the volume of fluid flow at the flow sensor, the flow sensor cooperating with the liquid detector to enable liquid flow of each processing liquid to be metered into the mixing tank.

81. The apparatus according to claim 80 wherein the flow sensor includes a conductivity sensor for sensing the presence of a liquid.

82. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank; and a film holder located within the processing drum for holding a batch of film to be processed in position contained within the drum for processing in the selected fluid mixture within the drum; and a liquid detector to enable the start of a liquid flow to be detected to enable metering of each processing liquid into the mixing tank; and a positive displacement pump cooperating with the liquid detector to enable a precise amount of each processing liquid to be dispensed into the mixing tank upon detection of a liquid flow by the liquid detector.

83. The apparatus according to claim 82 including a drain-back device cooperating with the source reservoirs to enable processing liquid to flow back into the respective source reservoir after the desired amount of such processing liquid has been pumped into the mixing tank.

84. The apparatus according to claim 82 including a flow sensor to detect the volume of fluid flow at the flow sensor to enable metering of the processing liquid into the mixing tank.

85. The apparatus according to claim 82 including a controller for controlling operation of the pump in response to the liquid detector to enable precise amounts of processing liquid to be dispensed into the mixing tank.

86. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

at least a second connector for connection with a second source reservoir for a second processing liquid including water to supply to the mixing tank to create the selected fluid mixture as a fresh mixture for processing film;

a liquid detector to enable the start of a liquid flow to be detected to enable metering of each processing liquid into the mixing tank; and a positive displacement pump cooperating with the liquid detector to enable a precise amount of each processing liquid to be dispensed into the mixing tank upon detection of a liquid flow by the liquid detector.

87. The apparatus according to claim 86 including a drain-back device cooperating with the source reservoirs to enable processing liquid to flow back into the respective source reservoir after the desired amount of such processing liquid has been pumped into the mixing tank.

88. The apparatus according to claim 86 including a flow sensor to detect the volume of fluid flow at the flow sensor to enable metering of the processing liquid into the mixing tank.

89. The apparatus according to claim 86 including a controller for controlling operation of the pump in response to the liquid detector to enable precise amounts of processing liquid to be dispensed into the mixing tank.

90. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

at least a second connector for connection with a second source reservoir for a second processing liquid including water to supply to the mixing tank to create the selected fluid mixture as a fresh mixture for processing film;

a third connector for connection with a third source reservoir for a third processing liquid including another selected processing liquid concentrate for supply to the mixing tank;

a liquid detector to enable the start of a liquid flow to be detected to enable metering of each processing liquid into the mixing tank; and a positive displacement pump cooperating with the liquid detector to enable a precise amount of each processing liquid to be dispensed into the mixing tank upon detection of a liquid flow by the liquid detector.

91. The apparatus according to claim 90 including a drain-back device cooperating with the source reservoirs to enable processing liquid to flow back into the respective source reservoir after the desired amount of such processing liquid has been pumped into the mixing tank.

92. The apparatus according to claim 90 including a flow sensor to detect the volume of fluid flow at the flow sensor to enable metering of the processing liquid into the mixing tank.

93. The apparatus according to claim 90 including a controller for controlling operation of the pump in response to the liquid detector to enable precise amounts of processing liquid to be dispensed into the mixing tank.

94. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

at least a second connector for connection with a second source reservoir for a second processing liquid including water to supply to the mixing tank to create the selected fluid mixture as a fresh mixture for processing film; and a valve intermediate the reservoir and the mixing tank to control liquid flow to the mixing tank.

95. The apparatus according to claim 94 wherein the valve includes a first surface and a second surface rotatably mounted relative to the first surface, the first surface having a plurality of inlet ports providing the connectors to the plurality of reservoirs, the second surface having an output port connected to the mixing tank, and the second surface being rotatable to register the outlet port to be in fluid communication with a selected inlet port.

96. The apparatus according to claim 95 comprising a motor operably connected to the rotational valve for rotating the second surface to select a fluid input.

97. The apparatus according to claim 94 comprising a motor operably connected to the valve, the motor for actuating the valve to select a fluid input.

98. The apparatus according to claim 94 wherein the valve is positionable to select one reservoir from the plurality of reservoirs to be in fluid communication with the mixing tank.

99. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum; and at least one discharge connector for connection with a discharge reservoir for receiving used fluid mixture from the processing drum.

100. The apparatus according to claim 99 including a pump coupled with the source reservoir to pump at least the processing liquid including the processing chemical concentrate into the mixing tank to replenish used fluid mixture.

101. The apparatus according to claim 100 including a liquid detector for detecting the start of a liquid flow to enable the pump to meter a precise amount of the processing chemical concentrate into the mixing tank.

102. The apparatus of claim 101 including a flow sensor to detect the volume of fluid flow at the flow sensor, the flow sensor cooperating with the liquid detector to enable the pump to meter liquid flow of each processing liquid into the mixing tank.

103. The apparatus of claim 100 wherein the source reservoir includes a second source reservoir for a second selected chemical concentrate and wherein the pump operates to pump the second chemical concentrate into the mixing tank.

104. The apparatus of claim 103 including a liquid detector for detecting the start of a liquid flow to enable the pump to meter a precise amount of the respective first and second processing chemical concentrates into the mixing tank.

105. The apparatus of claim 104 including a flow sensor to detect the volume of fluid flow at the flow sensor, the flow sensor cooperating with the liquid detector to enable the pump to meter liquid flow of each processing liquid into the mixing tank.

106. The apparatus according to claim 103 wherein the pump is in communication with the discharge reservoir for pumping a selected amount of used fluid mixture from the discharge reservoir to the mixing tank to mix with the first and second chemical concentrates to produce a replenished fluid mixture.

107. The apparatus according to claim 106 including a volume level sensor in the mixing tank for sensing the volume of replenished fluid mixture in the mixing tank.

108. The apparatus according to claim 100 wherein the pump is in communication with the discharge reservoir for pumping a selected amount of used fluid mixture from the discharge reservoir to the mixing tank to mix with the processing chemical concentrate to produce a replenished fluid mixture.

109. The apparatus according to claim 108 including a volume level sensor in the mixing tank for sensing the volume of replenished fluid mixture in the mixing tank.

110. The apparatus according to claim 99 comprising a valve intermediate the reservoir and the mixing tank to control liquid flow to the mixing tank.

111. The apparatus according to claim 110 wherein the valve includes a first surface and a second surface rotatably mounted relative to the first surface, the first surface having a plurality of inlet ports providing the connectors to the plurality of reservoirs, the second surface having an output port connected to the mixing tank, and the second surface being rotatable to register the outlet port to be in fluid communication with a selected inlet port.

112. The apparatus according to claim 111 comprising a motor operably connected to the valve for rotating the second surface to select a fluid input.

113. The apparatus according to claim 110 comprising a motor operably connected to the valve, the motor for actuating the valve to select a fluid input.

114. The apparatus according to claim 110 wherein the valve is positionable to select one reservoir from the plurality of reservoirs to be in fluid communication with the mixing tank.

115. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum; and a heater for heating the fluid mixture in the mixing tank.

116. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum; and a temperature sensor for measuring the temperature of the fluid mixture in the mixing tank.

117. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum; and a magnetic stirrer for mixing the fluid mixture in the mixing tank.

118. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

a first pump in fluid communication with the mixing tank for pumping the processing liquid from the reservoir into the mixing tank; and a level sensor operably connected to the mixing tank for measuring the fluid level within the mixing tank.

119. The apparatus according to claim 118 wherein the first pump is a positive displacement pump.

120. The apparatus according to claim 118 comprising a second pump in fluid communication with the mixing tank and in fluid communication with the processing drum for pumping the fluid mixture from the mixing tank to the processing drum.

121. The apparatus according to claim 120 wherein the second pump is a positive displacement pump.

122. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

a first pump in fluid communication with the mixing tank for pumping the processing liquid from the reservoir into the mixing tank, wherein said first pump is a positive displacement pump; and a level sensor operably connected to the mixing tank for measuring the fluid level within the mixing tank.

123. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum;

a first pump in fluid communication with the mixing tank for pumping the processing liquid from the reservoir into the mixing tank; and a second pump in fluid communication with the mixing tank and in fluid communication with the processing drum for pumping the fluid mixture from the mixing tank to the processing drum.

124. The apparatus according to claim 123 wherein the second pump is a positive displacement pump.

125. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank, said processing drum including a heater for heating the fluid mixture in the drum; and a film holder located within the processing drum for holding a batch of film to be processed in position contained within the drum for processing in the selected fluid mixture within the drum.

126. The apparatus according to claim 125 wherein the processing drum includes a temperature sensor for measuring the temperature of the fluid mixture in the drum.

127. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum; and at least a plurality of discharge reservoirs and at least one drain valve in fluid communication with the processing drum and in fluid communication with the discharge reservoirs, the drain valve selecting a discharge reservoir to receive the fluid mixture from the processing drum.

128. An apparatus for batch processing film comprising:

at least one connector for connection to a source reservoir containing at least a first processing liquid including a first processing chemical concentrate;

a mixing tank for fluid communication with the source reservoir for receiving and mixing the processing liquid with another processing liquid to provide a selected fluid mixture;

a processing drum in fluid communication with the mixing tank for receiving the selected fluid mixture from the mixing tank;

a film holder located within the processing drum for holding a batch of film to be processed in position contained within the drum for processing in the selected fluid mixture within the drum; and an agitator, included with said processing drum, for attachment to the film holder and for agitating the film within the fluid mixture.

129. An apparatus for batch processing film comprising:

at least one connector for connection to a source reservoir containing at least a first processing liquid including a first processing chemical concentrate;

a single mixing tank for fluid communication with the source reservoir for receiving and mixing the processing liquid with another processing liquid to provide a selected fluid mixture;

a single processing drum in fluid communication with the single mixing tank for receiving the selected fluid mixture from the single mixing tank;

rotary selector valving for communication with the connector to control the flow of liquid into the single processing drum; and a film holder located within the single processing drum for holding a batch of film to be processed in position contained within the drum for processing in the selected fluid mixture within the single processing drum.

130. The apparatus according to claim 129 comprising:

a single pump in fluid communication with the single mixing tank and single processing drum to pump fluid from the single mixing tank to the single processing drum.

* * * * *